US006207900B1

(12) United States Patent
Wagner

(10) Patent No.: US 6,207,900 B1
(45) **Date of Patent: *Mar. 27, 2001**

(54) HYBRID CABLE WITH CENTRAL LINE AND SUPPLEMENTARY CONDUCTORS

(75) Inventor: Dieter Wagner, Merkers (DE)

(73) Assignee: Alcatel, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/093,695

(22) Filed: Jun. 9, 1998

(30) Foreign Application Priority Data

Jun. 21, 1997 (DE) ..... 197 26 391

(51) Int. Cl.[7] ..... H01B 7/18; H01B 11/02

(52) U.S. Cl. ..... 174/102 R; 174/106 R; 174/113 R

(58) Field of Search ..... 174/36, 102 R, 174/102 C, 102 SP, 106 R, 113 R; 385/110

(56) References Cited

U.S. PATENT DOCUMENTS

| | | | | |
|---|---|---|---|---|
| 2,733,288 | * | 1/1956 | Webster | 174/28 |
| 3,316,344 | * | 4/1967 | Kidd et al. | 174/106 |
| 3,417,190 | * | 12/1968 | Body et al. | 174/36 |
| 3,963,854 | * | 6/1976 | Fowler | 174/36 |
| 4,432,605 | | 2/1984 | Niro et al. . | |
| 4,477,693 | * | 10/1984 | Krabec et al. | 174/36 |
| 5,132,491 | * | 7/1992 | Mulrooney et al. | 174/36 |
| 5,321,202 | * | 6/1994 | Hillburn | 174/36 |
| 5,329,064 | * | 7/1994 | Tash et al. | 174/36 |
| 5,467,420 | * | 11/1995 | Rohrmann et al. | 385/101 |
| 5,677,974 | * | 10/1997 | Elms et al. | 385/101 |
| 5,939,668 | * | 8/1999 | De Win | 174/36 |
| 5,960,144 | * | 9/1999 | Klumps et al. | 385/113 |

FOREIGN PATENT DOCUMENTS

| | | |
|---|---|---|
| 31 41 636 | 10/1981 | (DE) . |
| 37 33 747 | 10/1987 | (DE) . |
| 2 173 034 | 3/1985 | (GB) . |

* cited by examiner

*Primary Examiner*—Kristine Kincaid
*Assistant Examiner*—William H. Mayo, III
(74) *Attorney, Agent, or Firm*—Ware, Fressola, Van der Sluys & Adolphson LLP

(57) ABSTRACT

A hybrid cable is proposed with a central cable, in particular a coaxial line, and supplementary conductors (5, 6) running parallel to the central cable. The hybrid cable is characterized in that the supplementary conductors (5, 6) are arranged in layers and that the layer surface is oriented parallel to the surface of the central cable.

10 Claims, 1 Drawing Sheet

HYBRID CABLE WITH CENTRAL LINE AND SUPPLEMENTARY CONDUCTORS

BACKGROUND OF THE INVENTION

1. Technical Field

The invention relates to a hybrid cable with a central line, in particular a coaxial line, and supplementary conductors running parallel to the central line.

2. Description of the Prior Art

It is often necessary to combine a cable of a predetermined construction, for example a coaxial line, with supplementary conductors. In the presence of a central signal line, the supplementary conductors can be used for supplying power to a terminal or to an intermediate amplifier, or as supplementary signal lines. Applications include, for example, the cable of a satellite receiver antenna with a low noise biconverter requiring connection to a power supply as well as signal transmission, or coaxial cable networks for television programs to provide supplementary signal lines to enable users to simultaneously access a telephone connection.

The simplest way to manufacture a hybrid cable of this time is to insert supplementary strands in the jacket of the central line. However, especially for a small number of supplementary conductors, the shape of the cross-section of the resulting hybrid cable can deviate from the advantageous, mostly circular cross-section of the central line, making it more difficult to store and handle the cable. Moreover, the total cross-sectional area of the hybrid cable increases significantly and possibly also asymmetrically due to the required cross-section and insulation of the supplementary conductors. In the unexamined application DE 37 33 747, there is described a coaxial cable capable of transmitting with the help of supplementary conductors several signals at different potentials. However, this cable also has a complex construction and a relatively large diameter. It is also impractical because of the high costs to lay several individual cables.

SUMMARY OF THE INVENTION

It is therefore the object of the invention to obviate these disadvantages and to develop a hybrid cable with a total cross-sectional shape which corresponds to the shape of the cross-section of the central line and which has a minimum total cross-sectional area.

According to the basic concept of the invention, the supplementary conductors are in the form of layers wherein the layer surface is oriented parallel to the surface of the central line. Preferably, the layer-shaped conductors are positioned flat on the surface of the central line and arranged underneath the cable jacket; the layers are therefore frequently curved. Due to the layered structure, the supplementary conductors have a minimal thickness for a predetermined cross-section, thereby minimizing the total cross-section of the hybrid cable. The cross-sectional shape is also essentially identical to the shape of the central line. The symmetric cross-section makes the hybrid cable particularly easy to handle and store. The hybrid cable comprises preferably at least two supplementary conductors to make possible circuits which are completely separate from the central line. The hybrid cable is preferably manufactured by placing the supplementary conductors on the surface of the central line before or at the same time when the jacket is extruded, making the manufacture simple and inexpensive.

In an advantageous embodiment of the invention, the supplementary conductors are arranged so that only a portion of the circumference of the central line, for example a semi or quarter circle, i.e. a surface sector, is enclosed by an individual supplementary conductor. It is then possible to place all supplementary conductors at the identical constant spacing from the axis of the central line. If the number of supplementary conductors increases, the conductors could also be placed in an overlapping relationship, e.g. in several layers.

The supplementary conductors are preferably metal foils made from, e.g., aluminum or copper, which make possible an inexpensive manufacture of the hybrid cable.

To prevent the supplementary conductors from making contact with each other or with a bare outer conductor of the central line, at least one surface of the supplementary conductors is provided with an insulation. The supplementary conductors can then be placed with their insulation directly onto each other or onto the central line without making electrical contact. The supplementary conductors are preferably constructed of a coated support foil or of a composite foil having a metal layer and an insulating layer, e.g. a plastic material.

If the edges of adjacent supplementary conductors abut each other and only one side of the supplementary conductors carries insulation, then electrical contact can occur. To prevent such electrical contract, it is proposed to fold the edges of the supplementary conductors parallel to the axis in such a way that the insulation is disposed on the outside of the fold. The supplementary conductors can then be juxtaposed in abutting relationship even if the insulation is applied only to one side to reduce costs.

Alternatively, another suitable insulation can be formed by placing an insulating foil between the central line and the supplementary conductors, instead of or in addition to an insulating coating.

The supplementary conductors can contacted with the help of clamping contacts. The clamping contacts can either be placed on the surface of the supplementary conductors after removing the cable jacket, or the clamping contacts can puncture the cable jacket so as to contact the supplementary conductors.

In the following section of the description, an embodiment of the invention is described in more detail with reference to the schematic drawing.

DETAILED DESCRIPTION OF THE INVENTION

Figure 1:
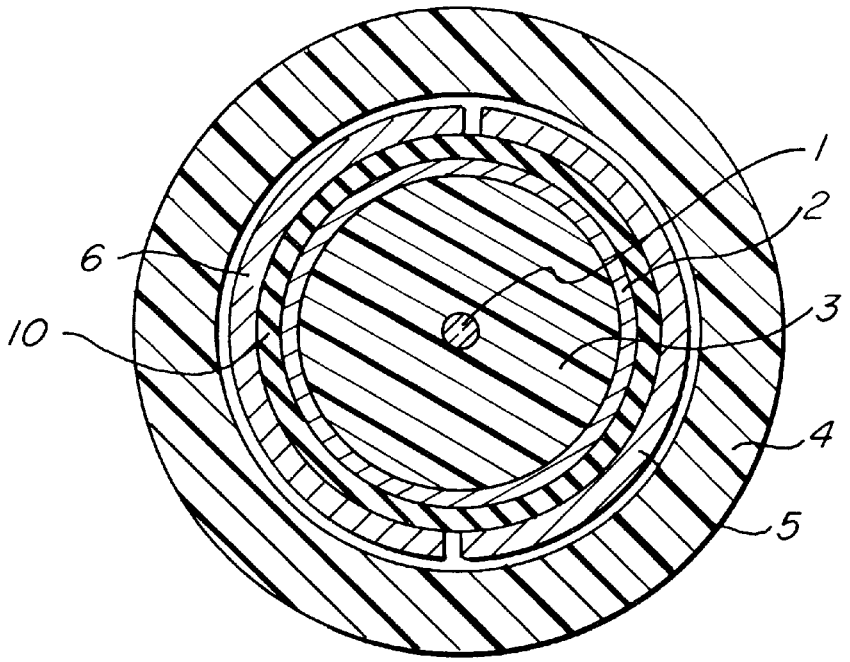
FIG. 1: a cross-sectional view through a hybrid cable of the invention perpendicular to the cable axis.

The central region of the hybrid cable is formed in a conventional manner by a coaxial line comprising an inner conductor 1, an outer conductor 2 and an interposed dielectric 3. The outside of the hybrid cable is enclosed by a cable jacket 4.

Between the outer conductor 2 of the central coaxial line and the cable jacket 4, there are disposed two layer-shaped supplementary conductors 5, 6 which lie flat against the outer conductor 2, so that the surfaces of the outer conductor 2 and of the supplementary conductors 5, 6 are oriented parallel to each other. Each supplementary conductor 5, 6 encloses a respective half of the outer conductor 2, i.e. the central line.

Figure 2:
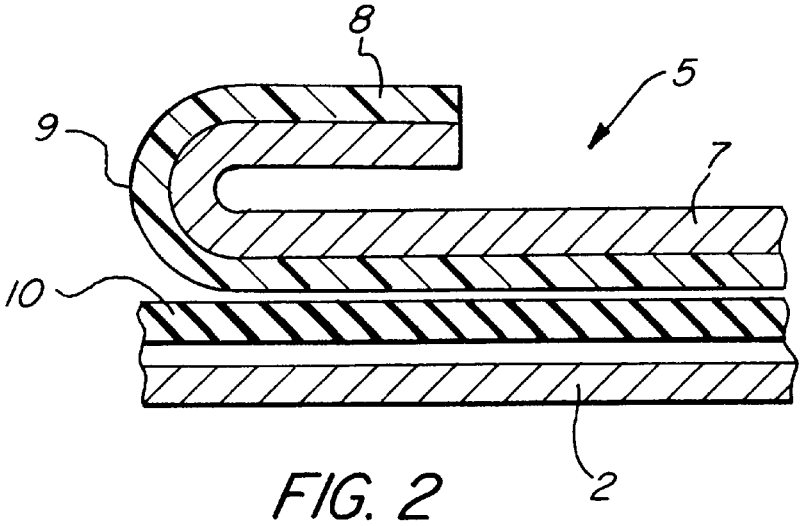
FIG. 2: an enlarged cross-sectional view in the region of an edge of a supplementary conductor.

FIG. 2 is an enlarged cross-sectional view of a supplementary conductor 5 in the region of one of its edges, before the cable jacket 4 is applied. The supplementary conductor 5 is made of a metal foil 7 with an insulation 8, preferably a plastic layer, disposed on the side facing the outside conductor 2. The supplementary conductor 5 is folded in the region of its edge 9 in such a way that the insulation 8 extends around the edge 9. With this construction, electrical contact is prevented in the case where edges of adjacent conductors 5, 6 touch each other. A foil 10 improves the insulation with respect to the outside conductor 2.

In summary, a hybrid cable is formed an which can be manufactured cost-effectively and advantageously has a circular cross-section and a small diameter.

The embodiments described above admirably achieve the objects of the invention. However, it will be appreciated that departures can be made by those skilled in the art without departing from the spirit and scope of the invention which is limited only by the following claims.

What is claimed is:

1. Hybrid cable, comprising (a) a central coaxial cable with a central conductor, a continuous extruded dielectric layer and an outer conductor, the hybrid cable having an outer surface;

(b) layer-shaped flat supplementary conductors arranged in at least one layer running parallel to the central coaxial cable, and spaced therefrom by a second dielectric layer, a surface of at least one layer of said flat supplementary conductors being oriented parallel to the surface of the central coaxial cable; and (c) an extruded insulating cable jacket surrounding said-central conductor, said continuous extruded dielectric layer and said layer-shaped flat supplementary conductors, and forming said outer surface.

2. Hybrid cable according to claim 1, wherein the central cable has a circular cross-section.

3. Hybrid cable according to claim 1, wherein each of said supplemental conductors encloses a portion of the central cable, thereby forming a surface sector.

4. Hybrid cable according to claim 1, wherein the supplementary conductors have identical spacings from a central axis of the central cable.

5. Hybrid cable according to claim 1, wherein each of said supplemental conductors is comprised of a metal foil.

6. Hybrid cable according to claim 1, wherein each of said supplemental conductors is provided with an insulation on at least one surface.

7. Hybrid cable according to claim 6, wherein edges of each of said supplemental conductors are parallel to a central axis of the central cable, and are folded to form a fold, so that at least a portion of the insulation is disposed on an outside portion of the fold.

8. Hybrid cable according to claim 7, wherein the supplementary conductors enclose the central coaxial cable to form sectors whereby adjacent edges of the supplementary conductors are insulated from one another.

9. Hybrid cable according to claim 1, wherein an insulating foil is disposed between a supplementary conductor and the central coaxial cable.

10. Hybrid cable according to claim 1, further comprising a clamping contact which makes contact with the supplementary conductors.

* * * * *

UNITED STATES PATENT AND TRADEMARK OFFICE

CERTIFICATE OF CORRECTION

PATENT NO. : 6,207,900 B1
DATED : March 27, 2001
INVENTOR(S) : Dieter Wagner

It is certified that error appears in the above-identified patent and that said Letters Patent is hereby corrected as shown below:

Title page,
Item [57], in the abstract, lines 1, 3 and 6, "central cable" should be -- cable line --.

Column 3,
Line 32 (claim 1, line 11), "-" should be deleted.

Signed and Sealed this

Second Day of October, 2001

*Attest:*

Nicholas P. Godici

*Attesting Officer*

NICHOLAS P. GODICI
*Acting Director of the United States Patent and Trademark Office*